US009333642B2

(12) United States Patent
Courtney

(10) Patent No.: US 9,333,642 B2
(45) Date of Patent: May 10, 2016

(54) CABINET JIG DEVICE WITH ADJUSTABLE FASTENERS AND RELATED METHODS

(71) Applicant: Brooks Courtney, North Port, FL (US)

(72) Inventor: Brooks Courtney, North Port, FL (US)

( * ) Notice: Subject to any disclaimer, the term of this patent is extended or adjusted under 35 U.S.C. 154(b) by 179 days.

(21) Appl. No.: 14/047,287

(22) Filed: Oct. 7, 2013

(65) Prior Publication Data

US 2015/0096179 A1 Apr. 9, 2015

(51) Int. Cl.

| | |
|---|---|
| ***B25H 7/04*** | (2006.01) |
| ***E04F 21/00*** | (2006.01) |
| ***E05B 17/06*** | (2006.01) |

(52) U.S. Cl.

CPC ..... *B25H 7/04* (2013.01); *E04F 21/003* (2013.01); *E05B 17/06* (2013.01); *Y10T 29/4984* (2015.01)

(58) Field of Classification Search

CPC .... E04F 21/003; E04F 21/0007; E05B 17/06; B25H 7/00; B25H 7/04; E05D 11/0009; Y10T 29/4984

USPC ..... 33/194, 456, 452, 666, 667, 464

See application file for complete search history.

(56) References Cited

U.S. PATENT DOCUMENTS

| | | | | |
|---|---|---|---|---|
| 2,582,606 | A * | 1/1952 | Riddle | 33/667 |
| 2,674,042 | A * | 4/1954 | Ott | 33/25.2 |
| 2,786,278 | A * | 3/1957 | Bates | 33/662 |
| 2,807,095 | A * | 9/1957 | Maxwell | E05B 17/06 33/450 |
| 2,821,027 | A * | 1/1958 | Billhimer, Sr. | 33/667 |
| 2,842,860 | A * | 7/1958 | Gray | 33/667 |
| 2,889,633 | A | 6/1959 | Simon | |
| 3,144,719 | A | 8/1964 | Ceravolo | |
| 3,583,823 | A * | 6/1971 | Eaton et al. | 408/115 R |
| 3,665,986 | A | 5/1972 | Johnson | |
| 4,085,902 | A * | 4/1978 | Wagner | 242/476.9 |
| 4,791,732 | A * | 12/1988 | Bruno, Jr. et al. | 33/578 |
| 4,981,400 | A | 1/1991 | Stover | |
| 5,507,607 | A * | 4/1996 | Ericksen et al. | 408/108 |
| 5,743,684 | A | 4/1998 | Rex | |
| 5,807,036 | A * | 9/1998 | Lostlen | 408/97 |
| 6,463,668 | B1 * | 10/2002 | Williams | 33/528 |
| 6,719,282 | B2 | 4/2004 | Frank | |
| 7,189,035 | B2 | 3/2007 | Miro | |
| 2002/0163115 | A1 | 11/2002 | Frank | |
| 2007/0036619 | A1 | 2/2007 | Miro | |
| 2007/0101598 | A1 * | 5/2007 | Miro | 33/667 |

OTHER PUBLICATIONS

"E-Z Pro Mortise and Tenon Jig," Rockler Woodworking Tools, Sep. 16, 2013, 2 pages.
"Cabinet and Drawer Installation Template Customer Reviews," Home Depot, Sep. 16, 2013, 7 pages.
"Blum Plate-Mate Drill Jig," CabinetParts, Sep. 16, 2013, 2 pages.
"Hafele 001.31.233 Drill Jig for Pulls," HomeDecorHardware, Sep. 16, 2013, 2 pages.
"Hafele 001.35.001 Quick Set Drill Jig for Pulls," HomeDecorHardware, Sep. 16, 2013, 2 pages.
"Hafele Drilling Jigs for Handles," Sep. 16, 2013, 1 page.

* cited by examiner

*Primary Examiner* — Christopher Fulton
(74) *Attorney, Agent, or Firm* — Allen, Dyer, Doppelt, Milbrath & Gilchrist, P.A.

(57) ABSTRACT

A cabinet jig device may include first and second crossbars, each crossbar having opposing first and second ends, a first leg extending between the first ends of the first and second crossbars, and a second leg extending between the second ends of the first and second crossbars. The cabinet jig device may include first and second adjustable fasteners for coupling the first leg respectively to the first ends of the first and second crossbars, third and fourth adjustable fasteners for coupling the second leg respectively to the second ends of the first and second crossbars, and first and second adjustable striking pins coupled to the second crossbar between the first and second ends thereof.

17 Claims, 5 Drawing Sheets

CABINET JIG DEVICE WITH ADJUSTABLE FASTENERS AND RELATED METHODS

FIELD OF THE INVENTION

The present invention relates to the field of hardware jigs, and, more particularly, to a cabinet jig device and related methods.

BACKGROUND OF THE INVENTION

The worldwide cabinetry/furniture industry is quite robust, grossing billions in annual revenue. This type of success is not unexpected given the ubiquitous nature of cabinetry work in residential and commercial structures. In many applications, the cabinetry pieces are attached to a wall. In other applications, the cabinetry pieces may be freestanding.

During manufacturing and assembly of some common cabinetry items, the attachment of hardware pulls (i.e. handles and knobs) can be problematic. In particular, the hardware pulls must be precisely aligned and installed onto drawer and door faces. Otherwise, the finished cabinetry piece may have diminished aesthetics. Commonly, since the end user may select the hardware pulls to satisfy personal taste or specific applications, the hardware pull may installed on site (by either professionals or homeowners). Accordingly, the installer is without typical precision manufacturing tools during installation of the hardware pull. This may require the installer to measure and align the hardware pull to the cabinetry piece, and accurately drill the through holes for receiving the hardware pulls.

An approach to this issue is the cabinet jig device. The cabinet jig device aids the installer in aligning the hardware pull and marking the cabinetry piece for drilling and installation. The typical cabinet jig device may suffer from several drawbacks. For example, the typical cabinet jig device may be difficult to position on ornate and deep cabinet facings. Also, the typical cabinet jig device may not be suitable for European style (i.e. extra long) hardware pulls.

SUMMARY OF THE INVENTION

In view of the foregoing background, it is therefore an object of the present invention to provide a cabinet jig device that is flexible and robust.

This and other objects, features, and advantages in accordance with the present invention are provided by a cabinet jig device comprising first and second crossbars, each crossbar having opposing first and second ends, a first leg extending between the first ends of the first and second crossbars, and a second leg extending between the second ends of the first and second crossbars. The cabinet jig device may include first and second adjustable fasteners for coupling said first leg respectively to the first ends of said first and second crossbars, third and fourth adjustable fasteners for coupling said second leg respectively to the second ends of said first and second crossbars, and first and second adjustable striking pins coupled to the second crossbar between the first and second ends thereof. Advantageously, the cabinet jig device may be readily used on a wide variety of cabinet applications.

In particular, each of the first and second adjustable striking pins may have opposing first and second ends, the first end being closed and the second end being open. The cabinet jig device may further comprise first and second studs to be positioned respectively in the second ends of the first and second adjustable striking pins, each of the first and second studs having a threaded external surface for receiving a cabinet hardware piece. The first ends of the first and second adjustable striking pins may each comprise a pointed end to define a striking point.

Each of the first and second legs may have first and second opposing ends, the first ends having an L-shape to engage a cabinet edge, the second ends each defining a longitudinal slot for receiving the second and fourth adjustable fasteners. The first cross bar may have first and second opposing ends respectively defining first and second longitudinal slots for receiving the first and third adjustable fasteners. The second cross bar may have first and second opposing ends respectively defining first and second longitudinal slots for receiving the second and fourth adjustable fasteners and the first and second adjustable striking pins.

In some embodiments, the second cross bar may have a plurality of measurement indications adjacent the first and second longitudinal slots thereof. Also, each of the first, second, third, and fourth adjustable fasteners may comprise a screw having a threaded external surface, and a threaded back nut for threadingly engaging the threaded external surface.

Another aspect is directed to a method for making a cabinet jig device. The method may comprise positioning first and second crossbars, each crossbar having opposing first and second ends, positioning a first leg to extend between the first ends of the first and second crossbars, and positioning a second leg to extend between the second ends of the first and second crossbars. The method may include positioning first and second adjustable fasteners to couple the first leg respectively to the first ends of the first and second crossbars, positioning third and fourth adjustable fasteners to couple the second leg respectively to the second ends of the first and second crossbars, and positioning first and second adjustable striking pins to couple to the second crossbar between the first and second ends thereof.

DETAILED DESCRIPTION OF THE PREFERRED EMBODIMENTS

Figure 1:
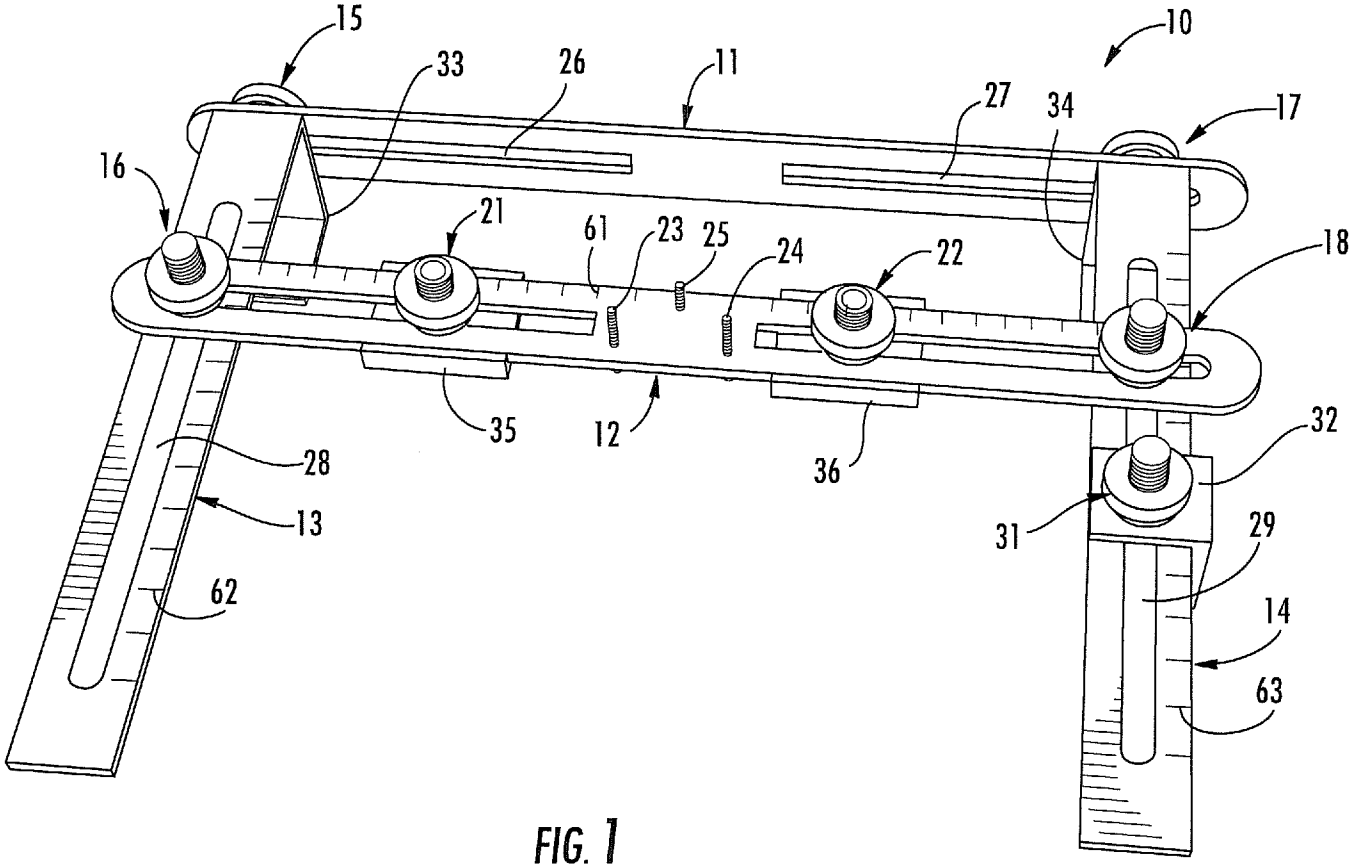
FIG. 1 is a perspective view of a cabinet jig device, according to the present invention.
Figure 2:
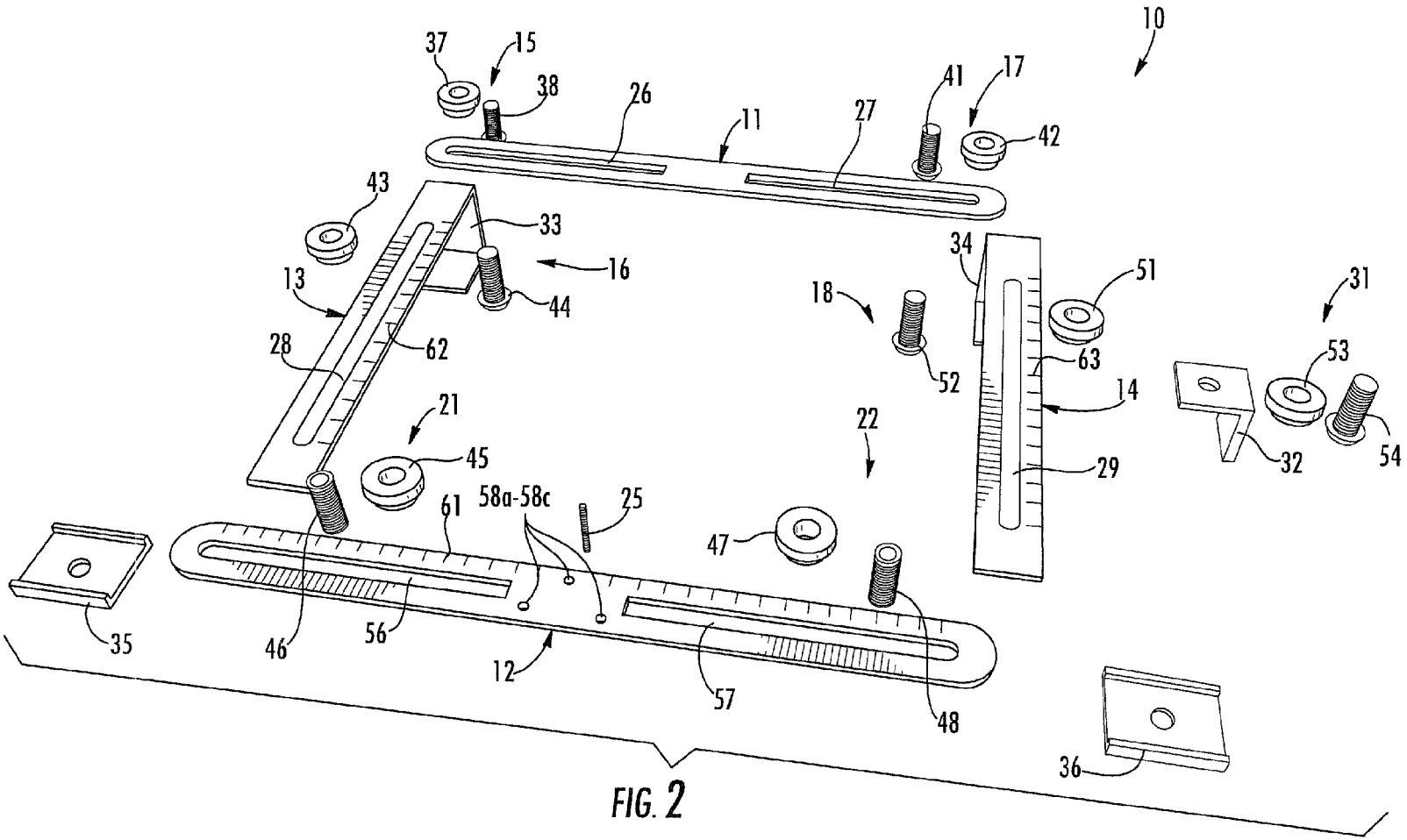
FIG. 2 is an exploded view of the cabinet jig device of FIG. 1.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Referring to FIGS. 1-5, a cabinet jig device 10 according to the present invention is now described. The cabinet jig device 10 may be used to mount a hardware pull onto a cabinetry piece. For example, the cabinetry piece may comprise a cabinet drawer or a cabinet door. Also, the hardware pull may comprise a handle, a knob, or a European style extra long handle. Indeed, the cabinet jig device 10 could be used for aligning and installation of many other devices to the cabinetry piece.

The cabinet jig device 10 includes first 11 and second 12 crossbars, each crossbar having opposing first and second ends. The cabinet jig device 10 includes a first leg 13 extending between the first ends of the first 11 and second 12 crossbars, and a second leg 14 extending between the second ends of the first and second crossbars. In some embodiments, the first 11 and second 12 crossbars may be elongated for use with extra long hardware pulls, such as European style handles. For example, in these embodiments, the first 11 and second 12 crossbars may be several times longer than that of those of the illustrated embodiment.

The cabinet jig device 10 includes first 15 and second 16 adjustable fasteners for coupling the first leg 13 respectively to the first ends of the first 11 and second 12 crossbars, third 17 and fourth 18 adjustable fasteners for coupling the second leg 14 respectively to the second ends of the first and second crossbars, and first 21 and second 22 adjustable striking pins coupled to the second crossbar between the first and second ends thereof. The first cross bar 11 has first and second opposing ends respectively defining first 26 and second 27 longitudinal slots for receiving the first 15 and third 17 adjustable fasteners.

The second cross bar 12 has first and second opposing ends respectively defining first 56 and second 57 longitudinal slots for receiving the second 16 and fourth 18 adjustable fasteners and the first 21 and second 22 adjustable striking pins. In the illustrated embodiment, the second cross bar 12 includes a plurality of measurement indications 61 adjacent the first 56 and second 57 longitudinal slots thereof. Additionally, the first 13 and second 14 legs also illustratively include a plurality of measurement indications 62, 63 thereon.

Each of the first 21 and second 22 adjustable striking pins illustratively includes a stud 46, 48 having a threaded external surface, a threaded back nut 45, 47 for threadingly engaging the threaded external surface of the stud, and a guide rail 35, 36 having a C-shape and engaging a backside of the second crossbar 12. The guide rail 35, 36 also defines a threaded passageway also for threadingly engaging the threaded external surface of the stud 46, 48.

Figure 3:
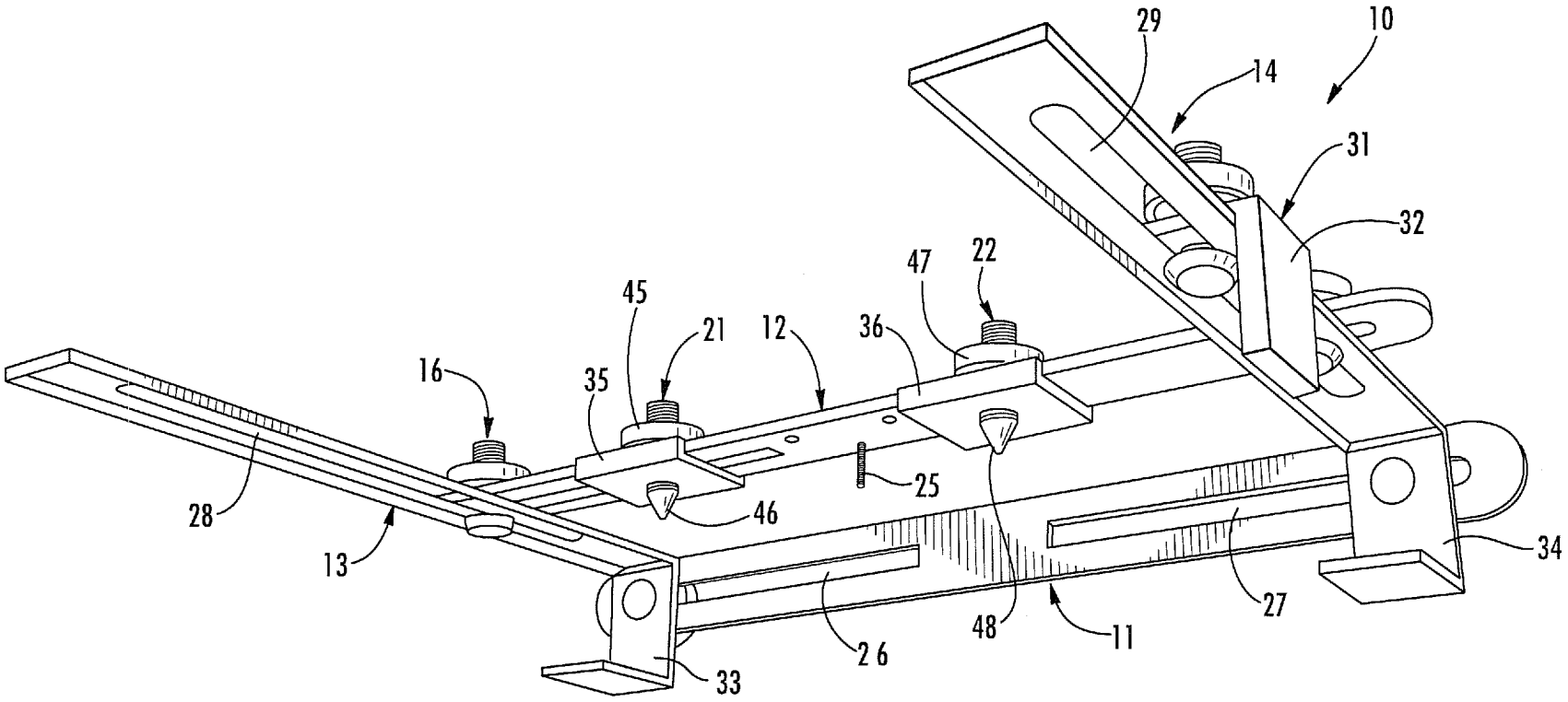
FIG. 3 is another perspective view of the cabinet jig device of FIG. 1.
Figure 4:
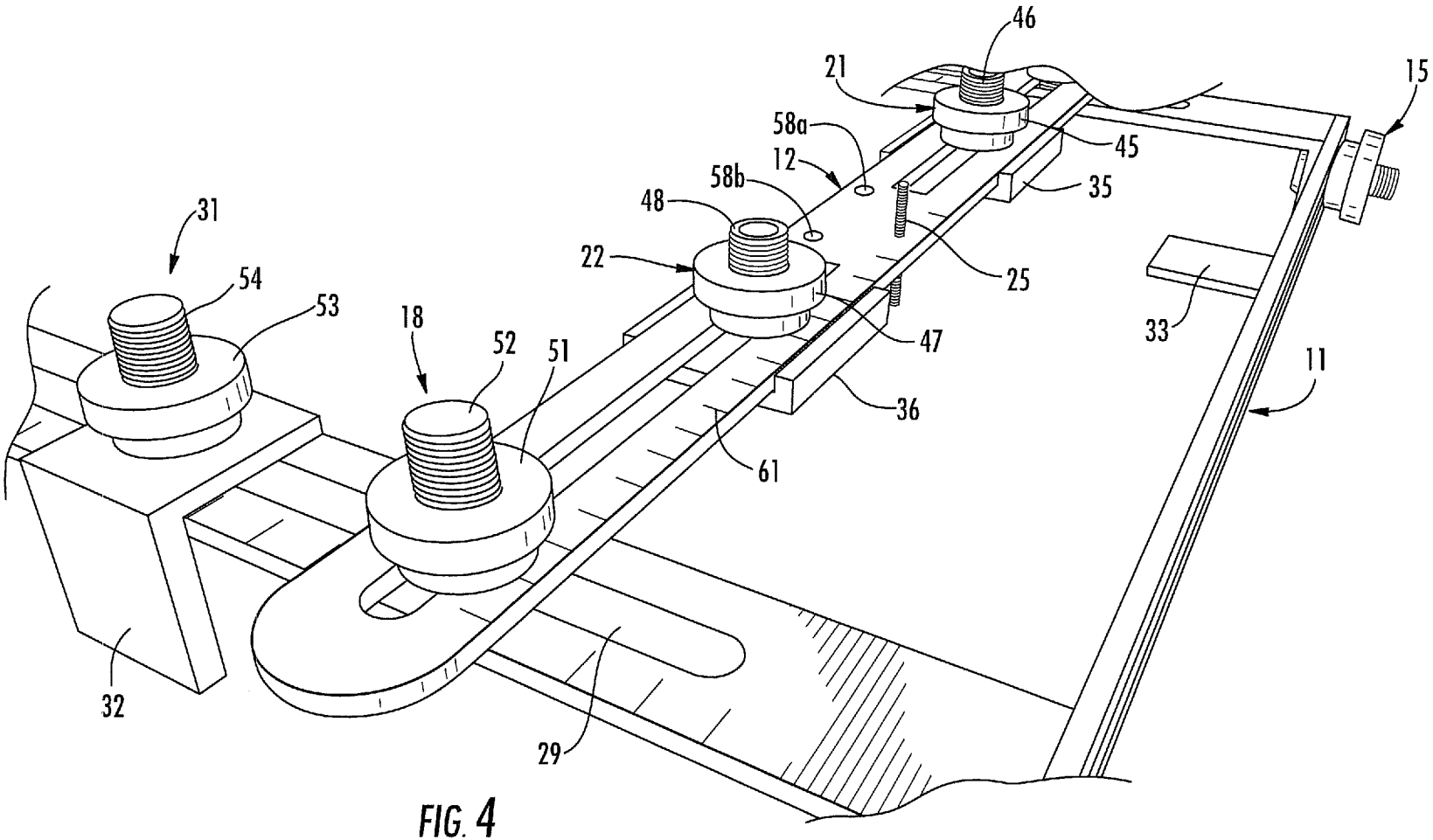
FIGS. 4-5 are additional perspective views of portions of the cabinet jig device of FIG. 1.
Figure 5:
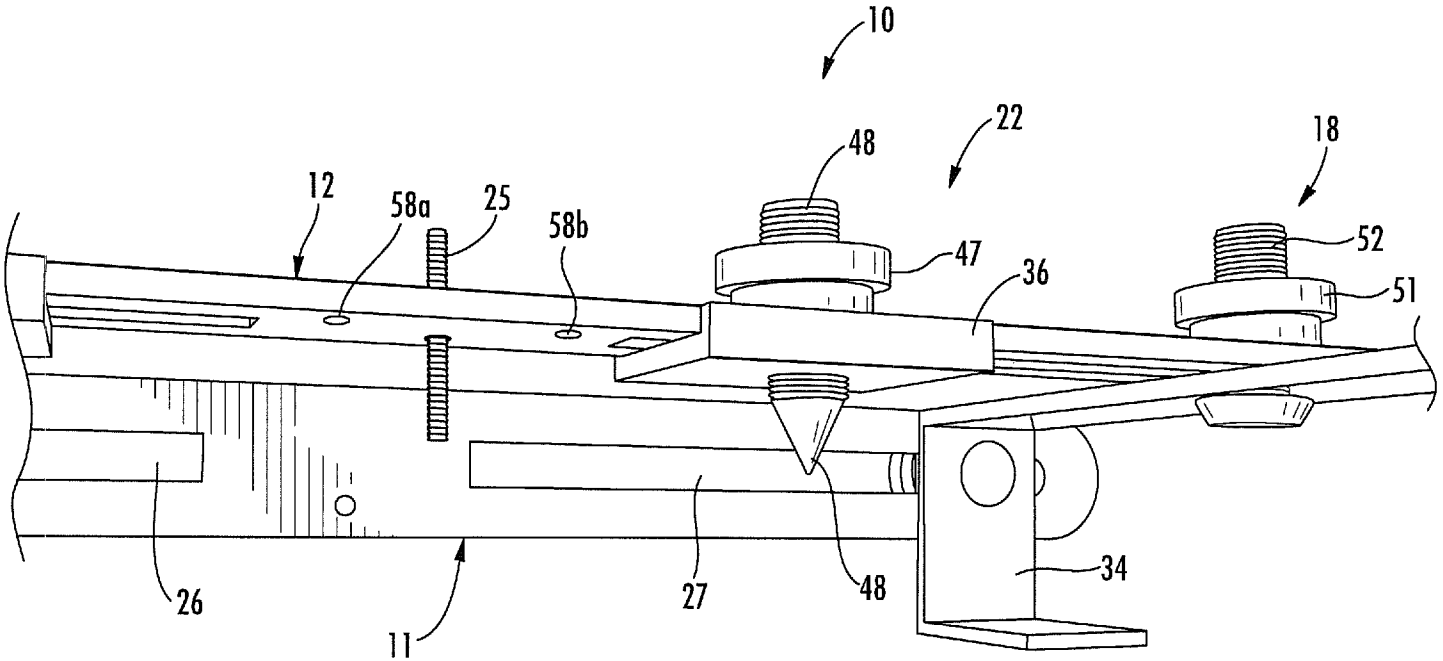

As perhaps seen in FIGS. 3 and 5, the studs 46, 48 illustratively include opposing first and second ends. The first end of the stud 46, 48 is closed and defines a conical point (i.e. a striking point). During mounting of the cabinet jig device 10 to the cabinetry piece, the conical point lies on a face of the cabinetry piece. The second end of the stud 46, 48 is open and receives the threaded back nut 45, 47. Advantageously, even with very ornate and deep faces for the cabinetry piece (i.e. a significant amount of decorative trim), the studs 46, 48 can be threadingly adjusted for depth to make solid contact with the face. Indeed, in some embodiments, the studs 46, 48 may have increased length, such as several inches. Of course, the studs 46, 48 can be threadingly adjusted for less depth for flat faced cabinetry pieces.

Helpfully, the cabinet jig device 10 illustratively includes a plurality of alignment studs 23-25 having threaded external surfaces. The second crossbar 12 illustratively defines a plurality of threaded passageways 58*a*-58*c* for respectively receiving the plurality of alignment studs 23-25. During mounting, the other alignment studs 23-24 may be threadingly removed from the second crossbar 12 and threadingly engaged with the hardware pull. Once attached to the hardware pull, the other alignment studs 23-24 are positioned within the second end of the studs 46, 48 of the first 21 and second 22 adjustable striking pins.

When first mounting the cabinet jig device 10 to the cabinet piece, the user should loosen each of the adjustable fasteners 16-18 and the first 21 and second 22 adjustable striking pins, permitting them to slide freely in their respective longitudinal slots 26, 27, 28, 29, 56, 57. During mounting of the cabinet jig device 10 to the cabinetry piece, the user may readily center the attached hardware pull using the center stud 25 by sliding the first 21 and second 22 adjustable striking pins along the slots 56, 57 of the second crossbar 12.

In particular, the user may use the measurement indications 61 on both sides of the center stud 25 to center the hardware pull (i.e. indicating an equal distance on both sides of the center stud). Once centered, the user removes the other alignment studs 23-24 from the first 21 and second 22 adjustable striking pins and may use a blunt force tool, such as a hammer or mallet, to apply force to the studs 46, 48. Due to the force, the conical end of the studs 46, 48 dents the face of the cabinetry piece. The user then may remove the cabinet jig device 10 from the cabinetry piece. The dented face of the cabinetry piece provides a point for the user to drill, thereby preventing drill bit wandering. Once the face of the cabinetry piece is drilled, the user may easily install the hardware pull (i.e. by the typical method of positioning a screw through a backside of the drill hole in the face and threadingly engaging the hardware pull thereon). It should be apparent to the skilled person that when the hardware pull is a knob-type pull, one of the first 21 and second 22 adjustable striking pins should be removed.

Each of the first 13 and second 14 legs has first and second opposing ends. The first ends of the first 13 and second 14 legs have an J-shape defining a hook 33, 34 to engage an edge of the cabinetry piece. In other embodiments, the first ends of the first 13 and second 14 legs have an L-shape. For example, while mounting the cabinet jig device 10 onto a cabinet drawer face, the hooks 33, 34 would rest on a top portion of the cabinet drawer face. The second ends of the first 13 and second 14 legs each define a longitudinal slot 28, 29 for receiving the second 16 and fourth 18 adjustable fasteners. Also, the cabinet jig device 10 illustratively includes a fifth adjustable fastener 31 for coupling an L-shaped support 32 to the second leg 14. The L-shaped support 32 provides a lateral support for mounting the cabinet jig device 10 to a cabinet door face, which may require a vertical arrangement for the cabinet jig device. Of course, depending on the orientation of the cabinet door face (i.e. leftward or rightward swinging door), the fifth adjustable fastener 31 and the L-shaped support 32 could be mounted on first leg 13 rather than the second leg 14.

Also, each of the first 15, second 16, third 17, fourth 18, and fifth 31 adjustable fasteners illustratively includes a screw 38, 44, 41, 52, 54 having a threaded external surface, and a threaded back nut 37, 43, 42, 51, 53 for threadingly engaging the threaded external surface of the screw. As will be appreciated, the threaded back nuts 37, 43, 42, 51, 53 and the screws 38, 44, 41, 52, 54 can be tightened or loosened to readily adjust the positioning of the first 15, second 16, third 17, fourth 18, and fifth 31 adjustable fasteners within the respective slots 26, 27, 28, 29, 56, 57. Also, the threaded back nuts 37, 43, 42, 51, 53, 45, 47 may comprise a textured outer radial surface for enhanced grip, permitting easy adjustment.

Another aspect is directed to a method for making a cabinet jig device 10 and that may comprise positioning first 11 and second 12 crossbars, each crossbar having opposing first and second ends, positioning a first leg 13 to extend between the first ends of the first and second crossbars, and positioning a second leg 14 to extend between the second ends of the first and second crossbars. The method may include positioning first 15 and second 16 adjustable fasteners to couple the first leg 13 respectively to the first ends of the first 11 and second 12 crossbars, positioning third 17 and fourth 18 adjustable fasteners to couple the second leg 14 respectively to the second ends of the first and second crossbars, and positioning first 21 and second 22 adjustable striking pins to couple to the second crossbar between the first and second ends thereof.

Advantageously, the cabinet jig device 10 may provide several benefits over the typical cabinet jig. The cabinet jig device 10 is easily adjustable along two dimensions, aiding in easy horizontal and vertical centering of the hardware pull on the face of the cabinetry piece. The cabinet jig device 10 is completely configurable with near infinite hardware pull positions, rather than the limit preset positions of the typical cabinet jigs. Also, the cabinet jig device 10 provides drill bit guides via indentations in the face of the cabinetry piece, which ensure accurate and reliable drilling. Moreover, the cabinet jig device 10 is readily adaptable to European style hardware pulls by exchanging the first 11 and second 12 crossbars for extra long versions. Furthermore, since the studs 46, 48 of the first 21 and second 22 adjustable striking pins are adjustable, the cabinet jig device 10 may be used on deep and ornate cabinetry faces.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A cabinet jig device comprising:

first and second crossbars, each crossbar having opposing first and second ends;

a first leg extending between the first ends of said first and second crossbars;

a second leg extending between the second ends of said first and second crossbars; and first and second depth adjustable striking pins coupled to said second crossbar between the first and second ends thereof;

each of said first and second depth adjustable striking pins comprising a threaded stud, said threaded stud having opposing first and second ends, the first end comprising a pointed end to define a striking point;

each of said first and second depth adjustable striking pins being threadingly adjustable in a path perpendicular relative to said second crossbar to permit extension of the striking point;

said first and second opposing ends of said second cross bar respectively defining first and second longitudinal slots for receiving and permitting movement of said first and second depth adjustable striking pins, the movement of said first depth adjustable striking pin being independent relative to said second depth adjustable striking pin.

2. The cabinet jig device of claim 1 wherein the second end of said threaded stud is open.

3. The cabinet jig device of claim 2 wherein each threaded stud has a threaded external surface for receiving a cabinet hardware piece.

4. The cabinet jig device of claim 1 further comprising:

first and second adjustable fasteners for coupling said first leg respectively to the first ends of said first and second crossbars; and third and fourth adjustable fasteners for coupling said second leg respectively to the second ends of said first and second crossbars;

wherein each of said first and second legs has first and second opposing ends, the first ends having an L-shape to engage a cabinet edge, the second ends each defining a longitudinal slot for receiving said second and fourth adjustable fasteners.

5. The cabinet jig device of claim 4 wherein said first cross bar has first and second opposing ends respectively defining first and second longitudinal slots for receiving said first and third adjustable fasteners.

6. The cabinet jig device of claim 4 wherein said first and second longitudinal slots of said second crossbar are for receiving said second and fourth adjustable fasteners.

7. The cabinet jig device of claim 4 wherein each of said first, second, third, and fourth adjustable fasteners comprises a screw having a threaded external surface, and a threaded back nut for threadingly engaging the threaded external surface.

8. The cabinet jig device of claim 1 wherein said second cross bar has a plurality of measurement indications adjacent the first and second longitudinal slots thereof.

9. A cabinet jig device comprising:

first and second crossbars, each crossbar having opposing first and second ends;

a first leg extending between the first ends of said first and second crossbars;

a second leg extending between the second ends of said first and second crossbars;

first and second adjustable fasteners for coupling said first leg respectively to the first ends of said first and second crossbars;

third and fourth adjustable fasteners for coupling said second leg respectively to the second ends of said first and second crossbars; and first and second depth adjustable striking pins coupled to said second crossbar between the first and second ends thereof, each depth adjustable striking pin having opposing first and second ends, the first end being closed and comprising a pointed end to define a striking point;

each of said first and second depth adjustable striking pins being adjustable in a path perpendicular relative to said second crossbar to permit extension of the striking point;

said second cross bar having first and second opposing ends respectively defining first and second longitudinal slots for receiving said second and fourth adjustable fasteners and said first and second depth adjustable striking pins.

10. The cabinet jig device of claim 9 wherein each of said first and second depth adjustable striking pins comprises a stud having a threaded external surface for receiving a cabinet hardware piece.

11. The cabinet jig device of claim 9 wherein each of said first and second legs has first and second opposing ends, the first ends having an L-shape to engage a cabinet edge, the second ends each defining a longitudinal slot for receiving said second and fourth adjustable fasteners.

12. The cabinet jig device of claim 9 wherein said first cross bar has first and second opposing ends respectively defining first and second longitudinal slots for receiving said first and third adjustable fasteners.

13. The cabinet jig device of claim 9 wherein said second cross bar has a plurality of measurement indications adjacent the first and second longitudinal slots thereof.

14. A method for making a cabinet jig device comprising:

positioning first and second crossbars, each crossbar having opposing first and second ends;

positioning a first leg to extend between the first ends of the first and second crossbars;

positioning a second leg to extend between the second ends of the first and second crossbars;

positioning first and second depth adjustable striking pins to couple to the second crossbar between the first and second ends thereof; and forming each of the first and second depth adjustable striking pins to comprise a threaded stud, the threaded stud having opposing first and second ends, the first end comprising a pointed end to define a striking point;

each of the first and second depth adjustable striking pins being threadingly adjustable in a path perpendicular relative to the second crossbar to permit extension of the striking point;

the first and second opposing ends of the second cross bar respectively defining first and second longitudinal slots for receiving and permitting movement of the first and second depth adjustable striking pins, the movement of the first depth adjustable striking pin being independent relative to the second depth adjustable striking pin.

15. The method of claim 14 wherein the second end of said threaded stud is open.

16. The method of claim 15 wherein each threaded stud has a threaded external surface for receiving a cabinet hardware piece.

17. The method of claim 14 further comprising:

positioning first and second adjustable fasteners to couple the first leg respectively to the first ends of the first and second crossbars; and positioning third and fourth adjustable fasteners to couple the second leg respectively to the second ends of the first and second crossbars;

wherein each of the first and second legs has first and second opposing ends, the first ends having an L-shape to engage a cabinet edge, the second ends each defining a longitudinal slot for receiving the second and fourth adjustable fasteners.

* * * * *